US007261467B2

(12) United States Patent
Kido et al.

(10) Patent No.: US 7,261,467 B2
(45) Date of Patent: Aug. 28, 2007

(54) FLEXIBLE CONTAINER BAG

(75) Inventors: Yoshitaro Kido, Taito-ku (JP); Tatsuya Sakata, Taito-ku (JP); Kazuhiko Kobayashi, Taito-ku (JP)

(73) Assignee: Nihon Matai Co., Ltd., Tokyo (JP)

( * ) Notice: Subject to any disclaimer, the term of this patent is extended or adjusted under 35 U.S.C. 154(b) by 526 days.

(21) Appl. No.: 10/487,227

(22) PCT Filed: May 14, 2002

(86) PCT No.: PCT/JP02/04628

§ 371 (c)(1),
(2), (4) Date: Feb. 25, 2004

(87) PCT Pub. No.: WO03/024844

PCT Pub. Date: Mar. 27, 2003

(65) Prior Publication Data

US 2004/0258330 A1 Dec. 23, 2004

(30) Foreign Application Priority Data

Sep. 13, 2001 (JP) ..... 2001-277794
Apr. 10, 2002 (JP) ..... 2002-107307

(51) Int. Cl.
*B65D 33/06* (2006.01)
*B65D 30/10* (2006.01)

(52) U.S. Cl. ..... 383/16; 383/121

(58) Field of Classification Search ..... 383/24, 383/121, 16, 32
See application file for complete search history.

(56) References Cited

U.S. PATENT DOCUMENTS

| | | | | |
|---|---|---|---|---|
| 3,445,055 | A * | 5/1969 | Port et al. | 383/32 |
| 5,695,286 | A * | 12/1997 | Williamson et al. | 383/24 |
| 6,447,165 | B1 * | 9/2002 | Grewe | 383/121.1 |
| 6,935,500 | B1 * | 8/2005 | Schnaars | 206/386 |
| 7,025,208 | B2 * | 4/2006 | Baker et al. | 206/599 |
| 2001/0030142 | A1 * | 10/2001 | Baker et al. | 206/599 |
| 2004/0159565 | A1 * | 8/2004 | Von Merveldt | 206/386 |
| 2005/0100248 | A1 * | 5/2005 | Chang | 383/21 |

FOREIGN PATENT DOCUMENTS

| | | |
|---|---|---|
| JP | 64-47687 | 3/1989 |
| JP | 5-330591 | 12/1993 |
| JP | 2000-272626 | 10/2000 |
| WO | WO 0073174 A1 | 12/2000 |

* cited by examiner

*Primary Examiner*—Jes F. Pascua
(74) *Attorney, Agent, or Firm*—Kratz, Quintos & Hanson, LLP

(57) ABSTRACT

A flexible container bag having a pallet function. To the bottom part of a flexible container bag body (2), tubular soft fork pocket members (3) are fixed at two positions. The fork pocket member (3) has opposite end parts in the longitudinal direction projecting outward from the container bag body (2). Inner face materials (6, 8) are fixed to the inside of the fork pocket member (3). Each inner face material (6, 8) is formed of a woven cloth employing PP monofilament.

9 Claims, 5 Drawing Sheets

FLEXIBLE CONTAINER BAG

TECHNICAL FIELD

The present invention concerns a flexible container bag having flexibility and, particularly, it relates to a flexible container bag that functions as a pallet.

BACKGROUND ART

Heretofore, it has been generally known to manufacture a container bag having flexibility by using, for example, non-woven fabrics or sheets made of plastics, in which various kinds of cargoes are loaded in the container bag for transportation.

By the way, since the existent flexible container bags have a structure only of the function as a container, they involve a problem of requiring pallets additionally to the flexible container bag upon handling by using a forklift.

In view of the above, it has been proposed a flexible container bag in which recesses are formed on both sides at the bottom of the container bag to form a shape where only the central portion protrudes downwards and, upon transportation by the use of forks, forks of the forklift are inserted into the recessed portions on both sides of the protrusion.

Since the existent flexible container bags require no pallets they have many advantages such as easy handlability but involve a problem that the stability during storage is poor since the bottom of the container bag is not flat. Further, they also involve a problem when the container bag is transported by using the forklift that the container bag may possibly detach from a portion on the fork when the bottom of the container bag is bent since the container bag is merely placed on the fork of the forklift.

The present invention has been accomplished in view of the foregoing situations and it is an object thereof to provide a flexible container bag capable of transportation with no use of a pallet by using a forklift, capable of inserting forks of a forklift into fork pockets with no troubles even in a case where heavy weight articles are contained in a container bag main body, free from the worry that the container bag main body should fall from a position on the fork during transportation by the forklift and having excellent stability during storage.

Another object of the invention is to provide a flexible container in which manufacture of fork pocket members are easy and, in addition, insertion of forks into the fork pockets is easy.

A further object of the invention is to provide a flexible container bag with no worry that the top end portions of protrusions of fork pocket members are not rolled into the fork pockets when the forks are inserted into the fork pockets.

A further object of the invention is to provide a flexible container bag capable of easily inserting forks into fork pockets even in a case where heavy weight product is fully contained in the container bag main body.

A further object of the invention is to provide a flexible container bag capable of keeping fork insertion ends of fork pockets always open.

A further object of the invention is to provide a flexible container bag capable of inserting forks easily into fork pockets and capable of opening fork insertion ends of the fork pockets by merely containing a cargo into a container bag main body.

A further object of the invention is to provide a flexible container bag capable of inserting forks of a forklift smoothly into fork pockets even in a state where the inside of the container bag main body is empty, or a small quantity of cargoes is contained therein, and free from the disadvantage that the fork pocket members are creased and the forks cannot be inserted.

A further object of the invention is to provide a flexible container bag with no worry that a container bag main body is detached from forks even in a case where a flowable cargo such as a resin is contained in the container bag main body.

A further object of the invention is to provide a flexible container bag capable of inserting forks smoothly into fork pockets even in a case where a cargo such as rice no more having flowability when packed is contained in a container bag main body by reducing the resistance between the fork pocket member and the fork.

A further object of the invention is to provide a flexible container bag free from the disadvantage that a container bag main body moves and the forks cannot be inserted even in a case where forks of a forklift are inserted into fork pockets in a state where a cargo is not contained in the container bag main body.

DISCLOSURE OF THE INVENTION

The present invention has a feature in comprising a flexible container bag main body with a substantially flat bottom; a soft fork pockets each disposed at the bottom of the container bag main body and forming a substantially cylindrical fork pocket in a state attached to the container bag main body, in which at least the lower surface at the top end on the fork insertion side of the fork pocket member is protruded outward of the outer edge of the container bag main body.

Since the fork pocket member is disposed at the bottom of the container bag main body, transportation by the use of a forklift is possible without using a pallet. Further, since at least the lower surface at the top end on the fork insertion side of the fork pocket member is protruded outward of the outer edge of the container bag main body, the fork can be inserted easily into the fork pocket even in a case where a cargo is fully contained in the container bag main body.

Further, the present invention has a feature in that the top end of the fork insertion side in the fork pocket member is cylindrically protruded outward of the outer edge of the container bag main body and an upper half and a lower half of the protruded portion are cut to separate. Then, this allows easy manufacture of the fork pocket member and easy insertion of the fork into the fork pocket.

Further, the present invention has a feature in that a rigidity improving treatment is applied to at least the lower half of the protrusion in the fork pocket member.

Then, this enables to avoid the protrusion of the fork pocket member from being rolled into the fork pocket upon insertion of the fork into the fork pocket and allows smooth insertion of the fork into the fork pocket.

Further, the present invention has a feature in that the container bag main body is provided with a pulling-up member for upwardly pulling-up the upper half of the protrusion in the fork pocket member.

This keeps the top end of the fork pocket member in a flared or opened state even in a case where a heavy weight product is fully contained in the container bag main body and allows easy insertion of the fork into the fork pocket.

Further, the present invention has a feature in that the upper half of the protrusion in the fork pocket member is provided with an insertion end reinforcement that bends and protrudes upward.

This allows the fork insertion end of the fork pocket to be kept always open.

Further, the present invention has a feature in that the upper half of the protrusion of the fork pocket member is fixed to the outer surface of the container bag main body in a state pulled upward.

This allows easy insertion of the fork into the fork pocket and, in addition, enables to open the fork insertion end of the fork pocket by merely containing a cargo in the container bag main body. Further, also in a case where the container bag main body is loaded being stacked on the container bag main body at the lower stage, the position for the fork pocket can easily be recognized visually from the outside.

Further, the present invention has a feature in that at least an upper portion on the inner surface of the fork pocket member is formed of a woven fabric using plastic filaments.

This can provide the upper portion on the inner surface of the fork pocket with a slidable surface having a predetermined rigidity and can avoid the disadvantage that the fork pocket member is creased and the fork cannot be inserted even in a case where the fork is inserted into the fork pocket in a state where a cargo is not contained in the container bag main body.

Further, the present invention has a feature in that the woven-fabric is formed by using plastic filaments, in which warps extending in the direction of inserting the fork have a smaller diameter while the wefts have a larger diameter.

This can avoid the disadvantage that the container bag main body should detach from the fork even in a case where a flowable cargo such as resin is contained in the container bag main body.

Further, the present invention has a feature in that the woven-fabric is formed by using plastic filaments, in which warps extending in the direction of inserting the fork have a larger diameter, while wefts have a smaller diameter.

Then, even in a case where a cargo such as rice no more having flowability when packed is contained in the container bag main body, resistance between the fork pocket member and the fork can be decreased to allow smooth insertion of the fork into the fork pocket.

Further, the present invention has a feature in that a less slippy treatment is applied to at least one of the grounding surface of the container bag main body or the fork pocket member.

Then, even when the fork of the forklift is inserted into the fork pocket in a state where a cargo is not contained in the container bag main body, there is no disadvantage that the container bag main body moves and the fork cannot be inserted.

BEST MODE FOR PRACTICING THE INVENTION

This invention is to be explained with reference to the drawings.

Figure 1:
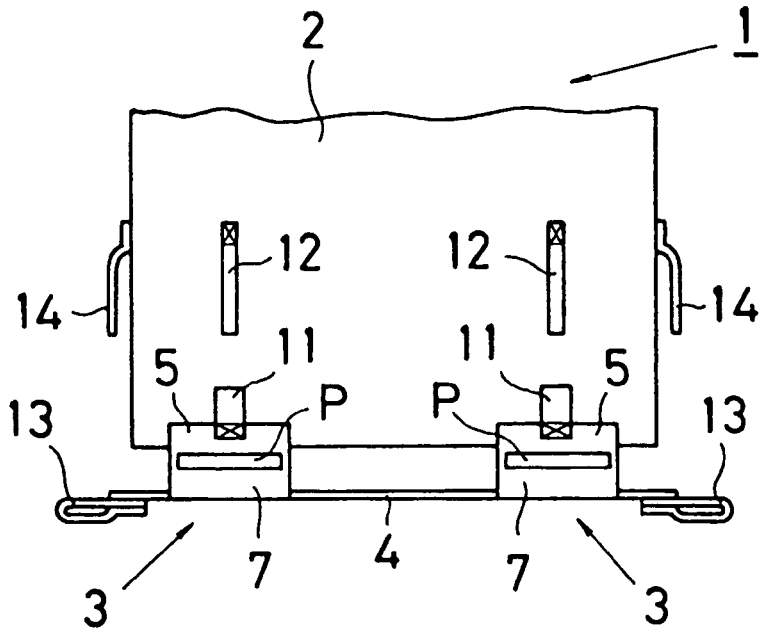
FIG. 1 is a constitutional view showing a flexible container bag as a first embodiment according to this invention.
Figure 2:
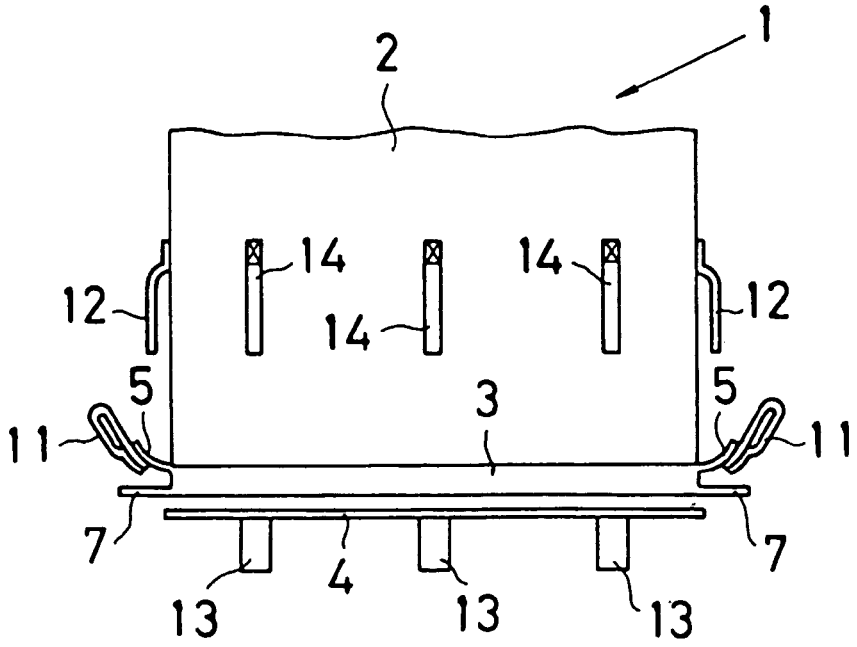
FIG. 2 is a side elevational view of the container bag shown in FIG. 1.
Figure 3:
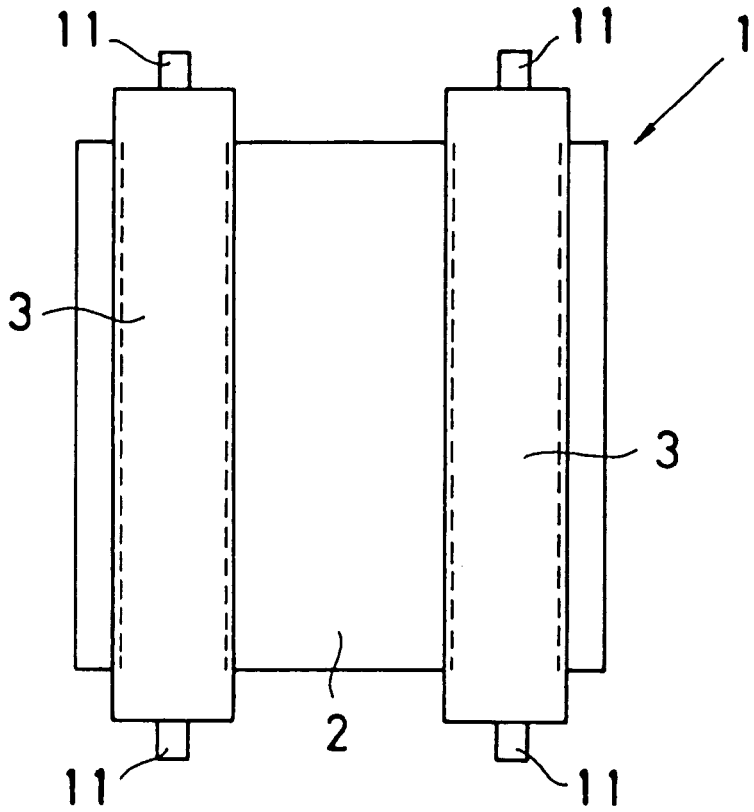
FIG. 3 is a constitutional view of the container bag main body shown in FIG. 1 as viewed from the bottom thereof.

FIG. 1 to FIG. 3 show a flexible container bag as a first embodiment according to this invention in which a flexible container bag 1 has a flexible container bag main body 2 in the form of a container having a substantially flat bottom. Flexible fork pocket members 3 for forming cylindrical fork pockets P for insertion of forks of a forklift not illustrated are attached at two positions at the bottom of the container bag main body 2. A bottom cover 4 is disposed on the side of the lower surface of the fork pockets so as to cover the fork pocket members 3 on the lower surface and so as to be detachably connected with the container bag main body 2.

Figure 4:
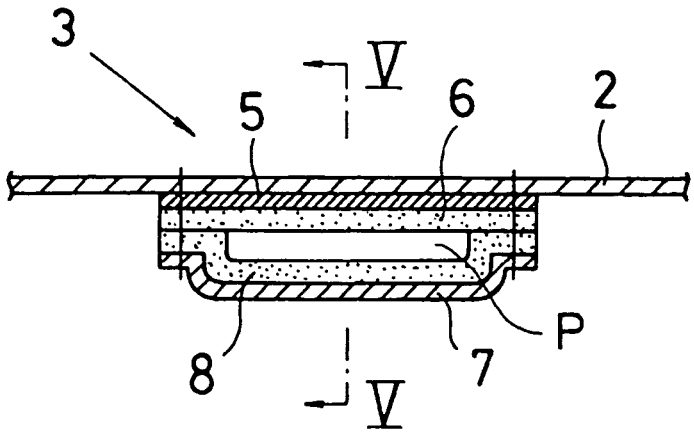
FIG. 4 is an enlarged cross sectional view showing details of a fork pocket member.
Figure 5:
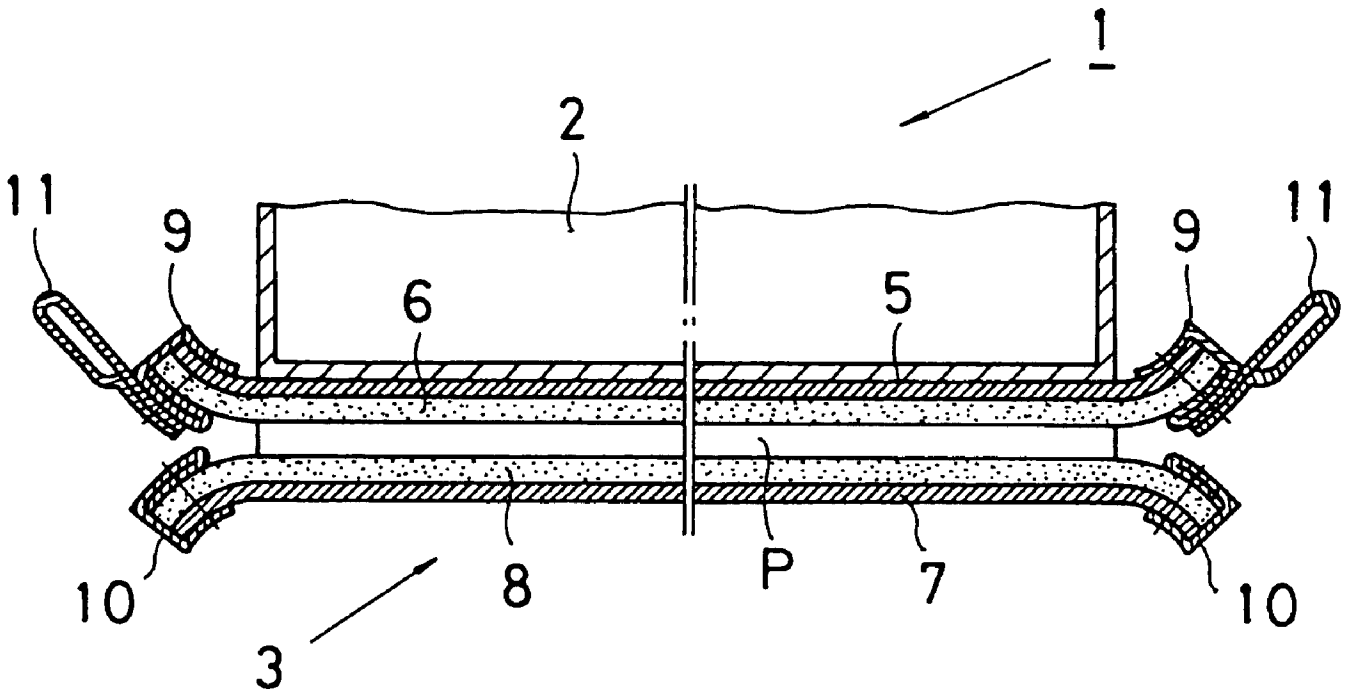
FIG. 5 is a cross sectional view taken along line V-V in FIG. 4.

As shown in FIG. 4 and FIG. 5, each of the fork pocket members 3 comprises an upper surface member 5 attached with an inner surface member 6 on the lower surface thereof and a lower surface member 7 attached with an inner surface member 8 at the upper surface thereof. As shown in FIG. 3 and FIG. 5, the length for both of the surface members 5 and 7 is set such that the both longitudinal ends thereof protrude outward of the outer edges of the container bag main body 2. Then, as shown in FIG. 5, the protruded portion is applied with a rigidity increasing treatment by being wrapped with a band-like edge wrapping members 9 and 10 and stitched, so that when forks are inserted into the fork pockets P, the ends for each of the surface members 5 and 7 are not rolled into the fork pockets P.

Further, as shown in FIG. 1 to FIG. 5, both of the surface members 5 and 7 are stitched to the container bag main body 2 only at the portions corresponding to the bottom of the container bag main body 2 and, accordingly, both of the longitudinal ends for both of the surface members 5 and 7 are cut to separate from each other. Thus, the forks can be inserted easily into the fork pockets P.

As shown in FIG. 5, a ring-like rope passing member 11 is stitched to a portion of the upper surface member 5 stitched with the edge wrapping member 9 and both of the longitudinal ends of the upper surface member 5 are pulled upward by binding a pull-up string 12 disposed on the lateral side of the container bag 2 to the rope passing member 11. Thus, the top end of the fork pocket member 3 is flared upward and downward for allowing easy insertion of the forks into the fork pockets P.

On the other hand, both of the inner surface members 6 and 8 are formed of woven fabrics, for example, made of PP mono-filaments in which the fineness of the filament is selected between 400 d (denier) and 200 d and in which filaments of diameter different from each other are used for warps extending in the fork insertion direction and wefts in perpendicular thereto.

That is, in a case where the diameter of the warp is made smaller and the diameter of the weft is made larger, a resistance relative to the forks of the forklift is somewhat increased. Accordingly, in a case where a cargo having flowability, for example, a resin is contained in the flexible container bag 1, detaching of the flexible container bag 1 from the forks during transportation can be prevented effectively by using the woven fabric having warps of smaller diameter and wefts of larger diameter.

On the other hand, in a case where the warps have a larger diameter and the wefts have a small diameter, resistance relative to the fork of the forklift is somewhat reduced. Thus, in a case where a cargo no more having flowability when packed, for example, rise is contained in the flexible container bag 1, the forks can be inserted smoothly into the forks pockets P to avoid the disadvantage that the forks are caught and can not be inserted by the use of the woven fabric having warps of larger diameter and the wefts of smaller diameter.

As shown in FIG. 1 and FIG. 2, plural binding rings 13 are attached to both end edges of the fork pocket members 3 arranged side by side in the bottom cover 4, respectively, and the bottom cover 4 is connected with the container bag main body 2 by binding each of the binding rings 13 to the binding string 14 disposed on the lateral side of the container bag main body 2. The bottom cover 4 may optionally be omitted and, in this case, when the container bag main body 2 has a discharge port at the bottom thereof, it is preferred to cover the discharge port by a protection cover for preventing intrusion of obstacles.

Since the fork pocket members 3 are attached integrally to the bottom of the container bag main body 2, the container bag main body 2 can be transported easily and safely by a forklift without using the pallet.

In the first embodiment described above, while explanation has been made to a case of forming each of the inner surface members 6 and 8 with a woven fabric made of PP mono-filaments, each of the inner surface members 6 and 8 may be formed of a woven fabric made of PE mono-filaments when it is necessary to improve the slidability further relative to the forks of the forklift.

Figure 6:
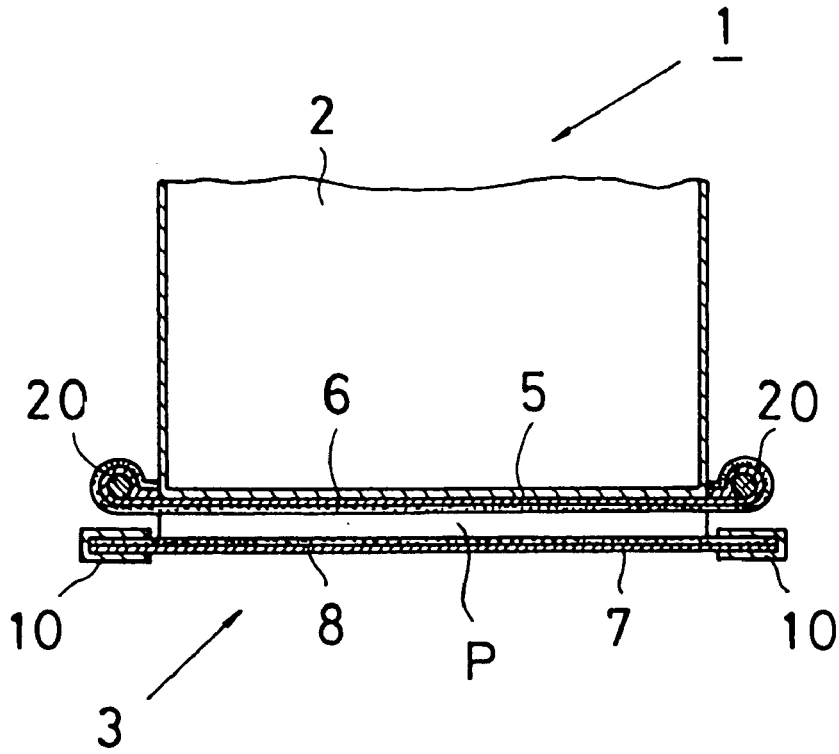
FIG. 6 is a view showing a second embodiment according to this invention, corresponding to FIG. 5.
Figure 7:
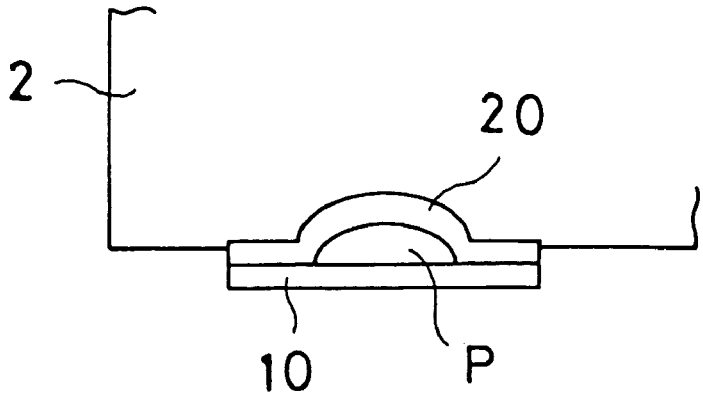
FIG. 7 is an explanatory view showing the configuration of an insertion end reinforcing member.

FIG. 6 and FIG. 7 show a second embodiment according to this invention in which an insertion end reinforcing member 20 is used instead of the rope passing member 11 and the pull-up string 12 in the first embodiment.

That is, as shown in FIG. 6, insertion end reinforcing members 20, for example, made of plastic ropes are disposed, respectively, to the portion of the upper surface member 5 protruding outward of the outer edge of the container bag main body 2. Each of the insertion end reinforcing members 20 is secured to the upper surface member 5, for example, by being wrapped and stitched with the upper surface member and the inner surface member 6. As shown in FIG. 7, the reinforcing member is shaped to convexly bend upward. Thus, the end of the fork pocket P can be always kept open.

Other constitutions and functions are identical with those of the first embodiment.

Since the insertion end reinforcing member 20 is disposed, the end of the fork pocket P can be always kept open and the fork of the forklift can be inserted easily into the fork pocket P.

Figure 8:
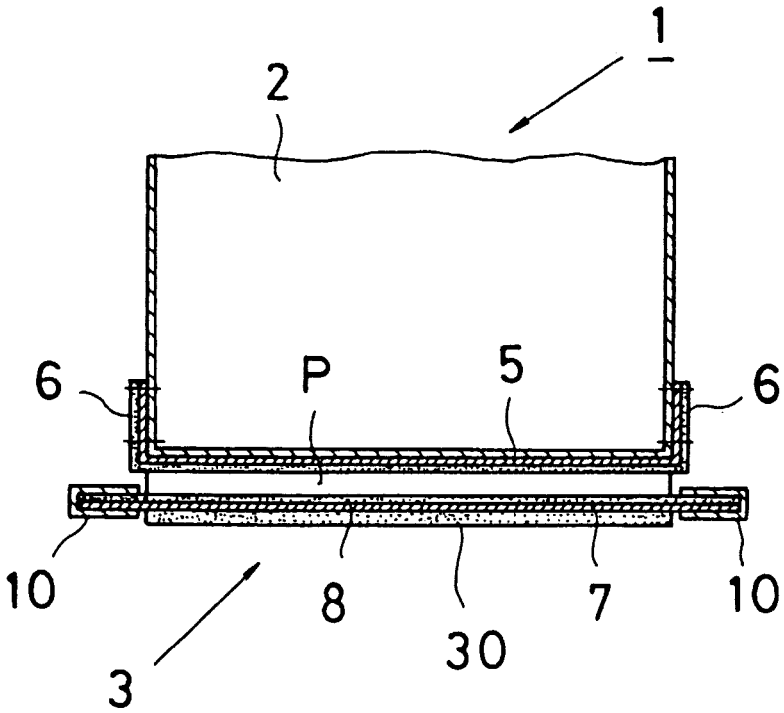
FIG. 8 is a view showing a third embodiment according to this invention, corresponding to FIG. 5.
Figure 9:
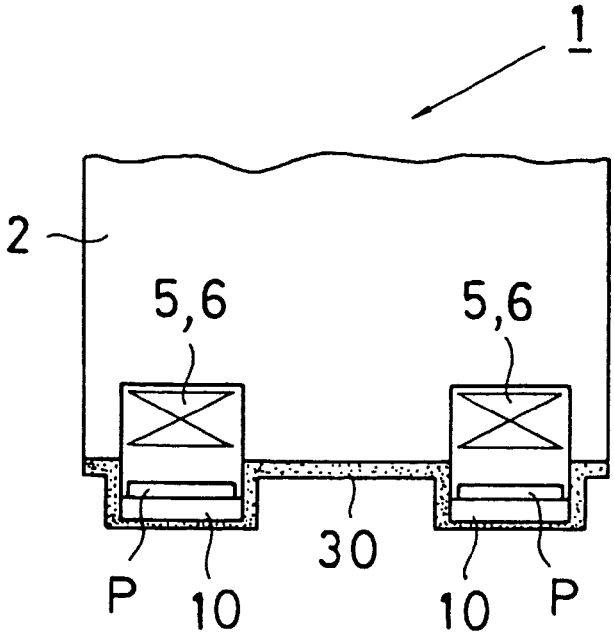
FIG. 9 is a side elevational view of the container bag shown in FIG. 8.

FIG. 8 and FIG. 9 show a third embodiment according to this invention in which the rope passing member 11 and the pull-up string 2 in the first embodiment are omitted, the end of the upper surface material 5 is secured directly to the outer surface of the container bag main body 2 and a less slippy sheet 30 is disposed to the grounding surface of the container bag main body 2 and the fork pocket member 3.

As shown in FIG. 8 and FIG. 9 the portion of the upper surface member 5 protruding outward of the outer edge of the container bag main body 2 is secured in a state being pulled upward to the outer surface of the container bag main body 2 by stitching or the like, while a less slippy sheet 30 such as made of an EVA sheet or rubber sheet is disposed integrally to the grounding surface of the container bag main body 2 and the lower surface member 7, for example, by means of lamination, sizing or sticking.

Other constitutions and functions are identical with those in the first embodiment described above.

When a cargo is contained in the container bag main body 2 by securing the end of the upper surface member 5 secured to the outer surface of the container bag main body 2, the end of the upper member 5 is pulled upward. Accordingly, the end of the fork pocket P can be opened. Further, since the end of the upper surface member 5 is exposed to the outer surface of the container bag main body 2, the position for the fork pocket P can easily be recognized visually. Further, slipping of the flexible container 1 can be prevented by the less slippy sheet 30 and there is no worry that the flexible container bag 1 moves upon insertion of the forks of the forklift into the fork pockets P in a state where a cargo is not contained in the container bag main body 2 to inhibit the insertion of the forks.

In each of the embodiments described above, explanation has been made to a case where the inner surface members 6 and 8 are disposed both to the upper surface and the lower surface of the fork pocket member 3, the intended effect can be expected by disposing the inner surface member 6 at least only on the side of the upper surface member 5.

For each of the embodiments described above, while explanation has been made to a case of forming the inner surface members 6 and 8 with the woven fabric made of the mono-filaments, they may be formed of plastic films.

It has been confirmed by the experiment made by the present inventors that, in a case of using the plastic film, it is preferred that the sliding friction coefficient thereof is preferably within a range shown in Table 1 and the strength thereof is preferably within a range of values shown in Table 2.

TABLE 1

| | Dynamic friction coefficient | Sliding angle converted value |
|---|---|---|
| min | 0.10 | 5.7° |
| max | 0.18 | 10.2° |

TABLE 2

| | Piercing strength [N] | Tear strength [N] |
|---|---|---|
| Vertical | 39 or more | 200 or more |
| Horizontal | 28 or more | 170 or more |

Further, in each of the embodiments described above, while explanation has been made to a case in which both of the upper surface member 5 and the lower surface member 7 protrude at both of the longitudinal ends outward of the outer edges of the container bag main body 2, the intended effect can be obtained so long as at least both of longitudinal ends of the lower surface member 7 protrude outward of the outer edge of the container bag main body 2.

Further, in each of the embodiments described above, while the explanation has been made to a case where the fork pocket member 3 has a completely cylindrical shape, the fork pocket member 3 may also be defined, for example, by stitching a band-like member to the bottom of the bag main body 2.

As has been described above, since this invention comprises a flexible container bag main body having a substantially flat bottom; and a soft fork pocket member disposed at the bottom of the container bag main body and forming a substantially cylindrical fork pocket in a state attached to the container bag main body, in which at least the lower surface at the top end of the fork pocket member in the fork insertion side protrudes outward of the outer edge of the container bag main body, the container bag can be transported by disposing the fork pocket members at the bottom of the container bag main body by using the forklift without using the pallet.

Further, since at least the lower surface at the top end of the fork pocket member on the fork insertion side is protruded outward of the outer edge of the container bag main body, the fork can be inserted easily into fork pocket even in a case where a cargo is contained fully in the container bag main body.

Further, in accordance with this invention, since the top end in the fork pocket member on the fork insertion side is protruded cylindrically outward of the outer edge of the container bag main body and the upper-half and the lower-half of the protruded portion are cut to separate, the fork pocket member can be manufactured easily and the fork can be inserted easily into the fork pocket.

Further, in accordance with this invention, since at least the lower-half portion of the protruded portion in the fork pocket member is provided with the rigidity increasing treatment the protruded portion of the fork pocket member is not rolled into the fork pocket upon insertion of the fork into the fork pocket, and the forks can be inserted smoothly into the fork pocket.

Further, in accordance with this invention, since the pull-up member for pulling the upper-half of the protruded portion in the fork pocket member is disposed to the container bag main body, the top end of the fork pocket member is in a flared state even in a case where a heavy weight product is fully contained in the container bag main body, so that the forks can be inserted easily into the fork pockets.

Further, in accordance with this invention, since an insertion end reinforcing member convexly bent upward is disposed to the upper-half of the protruded portion in the fork pocket member, the fork insertion end of the fork pocket can be kept always open.

Further, in accordance with this invention, since the upper-half of the protruded portion in the fork pocket member is secured to the outer surface of the container bag main body in the state pulled upward, the fork can be inserted easily into the fork pocket and, in addition, the fork insertion end of the fork pocket can be opened by merely containing cargoes in the container bag main body. Further, even in a case where the container bag main body is stacked on the container bag main body at the lower stage, the position for the fork pocket can be easily recognized visually from the outside.

Further, in accordance with this invention, since at least the upper portion on the inner surface of the fork pocket member is formed of the woven fabric made of plastic filaments, the upper portion on the inner surface of the fork pocket member has a slippy surface with a predetermined rigidity and, even in a case where the forks are inserted into the fork pockets in a state where a cargo is not contained in the container bag main body, there is no worry that the fork pocket members are creased and the forks can not be inserted.

Further, in accordance with this invention, since the woven fabric is formed of the plastic filaments in which the warps extending in the fork insertion direction have the smaller diameter and the wefts have the larger diameter, even in a case where a cargo having flowability such as resin is contained in the container bag main body, there is no worry that the container bag main body detaches from the forks.

Further, in accordance with this invention, since the woven fabric is formed of plastic filaments in which warps extending in the fork insertion direction have the larger diameter and wefts have the smaller diameter, even in a case where a cargo no more having flowability when packed such as rice is contained in the container bag main body, resistance between the fork pocket member and the forks can be reduced and fork can be inserted smoothly into the fork pockets.

Further, in accordance with this invention, since the grounding surface of at least one of the container bag main body and the fork pocket member is applied with the less slippy treatment, even in a case of inserting the forks of the forklift into the fork pockets in a state where a cargo is not contained in the container bag main body, there is no worry that the container bag main body moves and the forks can not be inserted.

INDUSTRIAL FIELD OF USE

As has been described above, the flexible container bag according to this invention is useful as a flexible container bag that functions as a pallet and, particularly, even in a case where a heavy weight cargo is contained in the container bag main body, the forks of the forklift can be inserted easily into the fork pockets, and is suitable as a flexible container bag also having favorable stability during transportation or storage.

The invention claimed is:

1. A flexible container bag, comprising a flexible container bag main body having an outer edge and a substantially flat bottom; and a soft fork pocket member forming substantially a cylindrical fork pocket, having an upper surface member, a lower surface member, and a fork insertion side, attached to the container bag main body in which at least a lower surface of the upper surface member at a top end of the fork pocket member on the fork insertion side protrudes beyond the outer edge of the container bag main body;

wherein the top end of the fork pocket member on the fork insertion side thereof protrudes cylindrically outward of the outer edge of the container bag main body to provide a protruded portion, and an upper-half and a lower-half of the protruded portion are cut to separate.

2. A flexible container bag as defined in claim 1, wherein at least a lower-half of the protruded portion in the fork pocket member is applied with a rigidity increasing treatment.

3. A flexible container bag as defined in claim 1 or 2, wherein the container bag main body has a pull-up member for pulling-up the upper-half of the protruded portion in the fork pocket member upward.

4. A flexible container bag as defined in claim 1, wherein the upper-half of the protruded portion in the fork pocket member has an insertion end reinforcing member convexly bent upward.

5. A flexible container bag as defined in claim 1 or 2, wherein the upper-half of the protruded portion in the fork pocket member is fixed to the outer surface in a state pulled-upward to the outer surface of the container bag main body.

6. A flexible container bag as defined in claim 1, 2 or 4 wherein at least the upper portion on the inner surface of the fork pocket member is formed of a woven fabric made of plastic filaments.

7. A flexible container bag as defined in claim 6, wherein the woven fabric is made of plastic filaments in which warps extended in the fork insertion direction have a smaller diameter and wefts have a larger diameter.

8. A flexible container bag as defined in claim 6, wherein the woven fabric is made of plastic filaments in which warps extended in the fork insertion direction have a larger diameter and wefts have a smaller diameter.

9. A flexible container bag as defined in claim 1, wherein a grounding surface of at least one of the container bag main body and the fork pocket member is applied with a less slippy treatment.

* * * * *